US006444117B1

(12) United States Patent
Khan et al.

(10) Patent No.: US 6,444,117 B1
(45) Date of Patent: Sep. 3, 2002

(54) SWEETENING OF SOUR CRUDES

(75) Inventors: M. Rashid Khan; Vincent P. Nero, both of Katy, TX (US); Lee Ann Brugger, Wallkill, NY (US); Stephen J. DeCanio, Katy; David A. Storm, Houston, both of TX (US)

(73) Assignee: Texaco, Inc., White Plains, NY (US)

( * ) Notice: Subject to any disclaimer, the term of this patent is extended or adjusted under 35 U.S.C. 154(b) by 0 days.

(21) Appl. No.: 09/640,125

(22) Filed: Aug. 16, 2000

(51) Int. Cl.[7] ..... C10G 27/00

(52) U.S. Cl. ..... 208/189; 208/207; 208/236; 208/237; 208/208 R

(58) Field of Search ..... 208/208 R, 236, 208/237, 189, 207

(56) References Cited

U.S. PATENT DOCUMENTS

| | | | | | |
|---|---|---|---|---|---|
| 2,238,201 | A | * | 4/1941 | Wilson et al. | 208/236 |
| 3,051,646 | A | | 8/1962 | Brooke | 208/250 |
| 3,378,484 | A | | 4/1968 | Ferrara et al. | 208/191 |
| 3,783,125 | A | | 1/1974 | Ondrey et al. | 208/191 |
| 3,977,972 | A | * | 8/1976 | Bloch et al. | 210/63 R |
| 4,098,684 | A | | 7/1978 | Innes | 208/245 |
| 4,180,457 | A | * | 12/1979 | Popp et al. | 208/188 |
| 4,548,708 | A | | 10/1985 | Schwarzer et al. | 208/196 |
| 5,213,680 | A | * | 5/1993 | Kremer et al. | 208/207 |
| 5,376,258 | A | | 12/1994 | Sakoda | 208/57 |
| 5,494,572 | A | | 2/1996 | Horii et al. | 208/263 |
| 5,582,714 | A | | 12/1996 | Forte | 208/237 |
| 5,961,820 | A | | 10/1999 | Jeanblanc et al. | 208/231 |
| 6,013,598 | A | | 1/2000 | Lapinski et al. | 502/305 |

OTHER PUBLICATIONS

Canadian Crude Terminal Resolves Tank–Odor Problems, by Wrubleski et al., *Oil and Gas Journal*, Oct. 27, 1997, pp. 50–56.

Importance of Inert–Gas Systems in Tankers Today, by J. E. Riley, *The Motor Ship*, Mar. 1976, pp. 115–116.

Optimization of Crude Stabilization Units, by G. Moins, *Oil and Gas Journal*, Jan. 21, 1980, pp. 91–93.

Summary Report: Hydrogen Sulfide in Residual Fuel Oil And Storage Tank Vapor Space, by D. Slack, *American Industrial Hygiene Association*, 49(4):205–20, 1988 no month.

* cited by examiner

*Primary Examiner*—Nadine Preisch
(74) *Attorney, Agent, or Firm*—Howrey, Simon, Arnold & White, LLP

(57) ABSTRACT

The general object of this invention is to provide an improved process for sweetening and desulfurizing sulfur-containing crude oil streams. Heating the sulfur-containing crude oil stream to an elevated temperature for an extended period of time while stirring and bubbling an inert gas into the crude accelerates the removal of sulfur containing gases from the crude oil stream. Furthermore, the addition of a polyalkylamine to the stirred crude oil can also greatly assist in the expulsion of sulfur containing gases. After processing under these conditions, the hydrogen sulfide producing capacity of the crude oil is reduced significantly, thus making the crude safer for transportation and handling by reducing the health and environmental risks.

14 Claims, No Drawings

SWEETENING OF SOUR CRUDES

BACKGROUND OF THE INVENTION

Elemental sulfur and sulfur compounds are naturally present in many petroleum crude oils. The amount of sulfur varies over a wide range; for example, crude petroleum from West Texas contains about 0.2 weight percent sulfur whereas crude petroleum from Saudi Arabia contains about 5.0 weight percent sulfur. There is also a wide variety of sulfur containing compounds present in the crude. These compounds range from hydrogen sulfide, which is a gas at room temperature, to heavy sulfur compounds that are released at over 1000° F. (538° C.).

Sulfur compounds are unlikable because of their disagreeable odors and because they oxidize to sulfur dioxide or hydrogen sulfide which are corrosive. The corrosive nature of sulfur compounds contributes significantly to the costs of construction, operation and maintenance of a petroleum refinery. If present in hydrocarbon products, sulfur compounds may cause problems in gasoline engines and can play a substantial role in environmental pollution. Furthermore, sulfur containing crude oil can generate hydrogen sulfide and other sulfur containing gases during transportation and handling which poses a serious health hazard to workers in the immediate area around the crude. Consequently, crude oils that emit sulfur species have a low market value.

When crude petroleum is processed in an oil refinery, one of the first steps is usually to separate the crude into various products based on boiling points. The unit typically used for this separation is a distillation column operated at atmospheric pressure and is commonly referred to as the crude still. The modern oil refinery processes yield a variety of useful fuels and desirable petroleum products, such as lower-boiling gasoline, to middle distillate fuels such as kerosene and diesel oil, to fuel oil for heating, and to higher-boiling waxes and heavy oils such as lubricating oil and asphalt products. The separation of the hydrocarbons also separates the sulfur compounds so that the lower-boiling hydrocarbons contain lower-boiling sulfur compounds and higher-boiling hydrocarbons contain higher-boiling sulfur compounds.

The sulfur compounds are undesirable in every hydrocarbon product coming off the crude still; however, the cause of the undesirability varies from fraction to fraction. It follows that, while most fractions are preferably treated as they come off the crude still to somewhat counteract the bad effects of the sulfur compounds, the preferred method of treatment varies from fraction to fraction.

An enormous amount of technology has developed relating to sweetening and desulfurizing gasolines and other petroleum stocks depending upon the particular type of sulfur compound to be removed. There are five basic processes that have been taught for sweetening and/or desulfurizing: oxidation reactions, solvent extraction, adsorption, metal catalysis, and hydrodesulfurization.

Oxidation reactions can be used to sweeten sour hydrocarbon streams by adding a chemical reagent that oxidizes sulfur components to form sulfides and/or disulfides, usually in the presence of metal reactants. These processes commonly add undesirable metal compounds that remain in the hydrocarbon stream and always require the burdensome step of phase separation. (Jeanblanc, et al., U.S. Pat. No. 5,961,820; Schwarzer et al., U.S. Pat. No. 4,548,708).

The solvent extraction process desulfurizes sour hydrocarbons by extracting the sulfur components from the hydrocarbons with a suitable solvent that is immiscible with the hydrocarbons. All of the solvent extraction processes suffer from the disadvantage of requiring a phase separation. (Forte, U.S. Pat. No. 5,582,714; Horii, et al., U.S. Pat. No. 5,494,752).

The adsorption process desulfurizes sour hydrocarbons by contact with a suitable high surface area adsorbent. Before 1945, bauxite and Fuller's earth were commonly used. Subsequent disclosures have taught the use of refractory oxides such as silica and alumina. More recently the use of certain molecular sieves has been disclosed. (Brooke, U.S. Pat. No. 3,051,646; Innes, U.S. Pat. No. 4,098,684).

Sweetening and/or desulfurizing a sulfur-containing hydrocarbon stream can also be achieved by contacting the stream with catalytic metals associated with porous supports. (Ferrara, U.S. Pat. No. 3,378,484; Ondrey, U.S. Pat. No. 3,783,125). Metals commonly used are generally found in Groups I-B, II-B, IV, V, VI, and VIII of the Periodic Table.

Finally, hydrodesulfurization desulfurizes hydrocarbons under conditions of elevated temperature and pressure by contacting the hydrocarbons with a large quantity of hydrogen gas in the presence of a special catalyst to form hydrogen sulfide. The hydrodesulfurization process has been widely used in oil refineries since about 1955 and is predicated on the availability of hydrogen gas at the refinery. Recently, however, it has been desired to treat hydrocarbons with higher sulfur concentrations resulting in an increased demand for the hydrogen gas required to treat hydrocarbons using this process. Thus, the readily available sources of hydrogen gas in an oil refinery may no longer be adequate for hydrodesulfurization. (Lapinski, et al., U.S. Pat. No. 6,013,598; Sakoda, U.S. Pat. No. 5,376,258).

SUMMARY OF THE INVENTION

The general object of this invention is to provide an improved process for sweetening and desulfurizing sulfur-containing hydrocarbon streams. The more specific objects are to provide a process which does not require the addition of metal reactants, does not require a phase separation of the hydrocarbons from an immiscible solvent, does not require the presence of a metal catalyst, and does not require the addition of hydrogen gas. Furthermore, this invention is directed at treating the crude feedstock, which could eliminate the need to treat individual products and make the feedstock safer for transportation and handling.

It has been discovered that these objects can be obtained by heating the sulfur-containing crude oil stream to a temperature of about 250° F. (121° C.) to 600° F. (316° C.) for about 1 to 4 hours. Simultaneously, an inert gas, such as nitrogen or carbon dioxide, is bubbled into the crude while the crude is being stirred. This process accelerates the removal of sulfur containing gases from the crude oil stream. After processing under these conditions, the hydrogen sulfide producing capacity of the crude oil is reduced significantly, thus making the crude safer for transportation and handling by reducing the health and environmental risks.

It has further been discovered that the addition of a polyalkylamine to the stirred crude oil can also greatly assist in the expulsion of sulfur containing gases. It has been found that these compounds can accelerate hydrogen sulfide formation in the crude oil approximately 5 to 15 times, further minimizing the sulfur emission problem of crude oil after processing.

DESCRIPTION OF ILLUSTRATIVE EMBODIMENTS

In one embodiment of this invention, crude oil is sweetened and/or desulfurized by a thermal process that involves heating the crude to a relatively high temperature, 300° F. (149° C.) to 600° F. (316° C.), for a residence time of 1 to 4 hours.

Upon mild heating, hydrogen sulfide ($H_2S$) has been shown to begin evolving from the crude oil. The production of $H_2S$ from crude oil that has been mildly heated is not a transitory phenomenon, as continued $H_2S$ evolution occurs over a very long period of time. Thus, the shipping and handling of crude oil can be dangerous. Sour crude will begin to produce $H_2S$ (in the vapor phase above the crude) as soon as any heating begins and will continue throughout the period of any mild heating. The sources of $H_2S$ from the crude are dissolved $H_2S$ and/or generated $H_2S$ produced by the reaction or decomposition of sulfur components in the crude. By pre-heating the crude to the above temperatures for up to 4 hours, the $H_2S$ producing capacity of the crude can be effectively reduced.

During the heating step it is preferred that the crude be stirred or mixed so that the heated crude can expel the $H_2S$ and other sulfur containing gases as they are either released or produced from the crude. The stirring rate can be anywhere between 10 and 5000 rpm which could be applied by a conventional stirrer or other mixing devices. An inert gas, such as $N_2$ or a waste flue gas containing mostly $CO_2$ (greater than 50%), may also be bubbled in to the crude to assist in the sulfur gas removal. Upon completion of this embodiment, there will be a dramatic reduction in the $H_2S$ and other sulfur containing gases from the crude, making the crude safer for transportation and handling, more environmentally friendly, and less likely to pose significant health risks to any workers around the crude.

The vapor that is produced from this heat treatment can be condensed to recover any condensable hydrocarbons that may also have been removed from the crude. If the crude has not yet been de-watered, a process by which the substantial amount of water found in crude oil is removed, the vapor that is produced from this heat treatment can contain water vapor. The vapor that is produced from this heat treatment may also be cooled to condense the water vapor.

Significant levels of hydrogen sulfides and other sulfur containing gases are released from crude oil if the crude is exposed to high temperatures for an extended period of time. Although thermal treatment alone can significantly reduce the sulfur containing gas production capability of a crude stream, high levels of $H_2S$ can persist even after a period as long as several days at elevated temperatures. These emissions can be controlled by limiting the heat applied to the crude after the initial thermal treatment, but where there may be an extended period of heating, additional steps will need to be taken to limit $H_2S$ production.

Another preferred embodiment of this invention involves sweetening and/or desulfurizing crude oil by adding catalytic additives to the crude. In this embodiment, the sulfur components of the crude are contacted with a polyalkylamine during thermal processing. The thermal processing step is similar to that of the previous embodiment, where the mixture of the crude and the catalyst is heated to a temperature of 250° F. (121° C.) to 600° F. (316° C.) for a residence time of 1 to 4 hours. The mixture of the crude and the polyalkylamine should be stirred or mixed during the thermal processing step so that the heated crude can expel the sulfur containing gases.

The addition of a polyalkylamine can accelerate $H_2S$ formation from sulfur containing components in the crude as much as 5 to 15 times. Preferred linear polyalkylamines are diethylene triamine (DETA), tetraethylene pentaamine (TEPA), and pentaethylene hexamine (PEHA). Preferred cyclic polyalkylamines are aminoethylpiperidine (AEP) and 1,4,8,11-tetra azocyclotetradecane (TACTD). The amount of polyalkylamine should be sufficient to accelerate $H_2S$ formation. The addition of a polyalkylamine preferably is between about 100 ppm and 3000 ppm, with a more preferred concentration of 0.2% by weight (2000 ppm).

It is believed that the polyalkylamines accelerate the release of sulfur containing vapors during heating of the crude oil by promoting the conversion of sulfur containing components into $H_2S$ and other sulfur containing vapors. This provides a means to both minimize subsequent $H_2S$ and other sulfur containing vapor emissions problems from the crude oil stream while simultaneously enhancing the crude value by removing elemental sulfur.

As in the first embodiment, the vapor that is produced from this thermal polyalkylamine treatment can be condensed to recover any condensable hydrocarbons that may also have been removed from the crude. If the crude has not yet been de-watered, the vapor that is produced from this thermal polyalkylamine treatment can contain water vapor and thus could be cooled to condense the water vapor.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the scope of the invention.

Unless otherwise stated, all starting materials are commercially available and standard laboratory techniques and equipment are utilized.

EXAMPLES

Example 1

$H_2S$ Emission from Crude Oil

A series of measurements were done to better understand the chemistry of $H_2S$ evolution as a function of crude processing by evaluating the off-gas concentration of $H_2S$ in various sour 'E' crude samples. Each sample was taken from the field at a wellhead sample valve, and shipped to the lab in sample containers. Upon receipt, the crude was analyzed for various components, including carbon species and sulfur species.

TABLE 1

CRUDE OIL EMISSIONS RESULTS

| C %/S % | Sample 1 79.9/ 4.74 | Sample 2 82.7/ 3.95 | Sample 3 78.9/ 5.21 | Sample 4 75.3/ 4.51 | Sample 5 83.2/ 3.95 |
|---|---|---|---|---|---|
| Initial $H_2S$ Reading | <25 ppm | >500 ppm | >500 ppm | >500 ppm | >500 ppm |
| 100° F. (38° C.), 2 hours | >500 ppm | >500 ppm | >500 ppm | >500 ppm | >500 ppm |
| 100° F. (38° C.), 13 days | <20 ppm | >500 ppm | >500 ppm | >500 ppm | >500 ppm |
| 100° F. (38° C.), 42 days | <20 ppm | >500 ppm | >500 ppm | >500 ppm | >500 ppm |
| 212° F. (100° C.), 2 | >500 | >500 | >500 | >500 | >500 |

TABLE 1-continued

CRUDE OIL EMISSIONS RESULTS

| C %/S % | Sample 1 79.9/ 4.74 | Sample 2 82.7/ 3.95 | Sample 3 78.9/ 5.21 | Sample 4 75.3/ 4.51 | Sample 5 83.2/ 3.95 |
|---|---|---|---|---|---|
| hours | ppm | ppm | ppm | ppm | ppm |
| 212° F. (100° C.), 13 days | >500 ppm | >500 ppm | >500 ppm | >500 ppm | >500 ppm |
| 212° F. (100° C.), 42 days | >500 ppm | >500 ppm | >500 ppm | >500 ppm | >500 ppm |
| 300° F. (149° C.), 2 hours | >500 ppm | >500 ppm | >500 ppm | >500 ppm | >500 ppm |
| 300° F. (149° C.), 13 days | >500 ppm | >500 ppm | >500 ppm | >500 ppm | >500 ppm |
| 300° F. (149° C.), 42 days | >500 ppm | >500 ppm | >500 ppm | >500 ppm | >500 ppm |

The initial vapor space $H_2S$ concentrations in each sample were greater than 500 ppm, the maximum detection limit of the detector used, with the exception of the 1st sour crude E sample. The results show that $H_2S$ concentrations measured in all crude samples were significant and remained significant at all temperatures (ranging from 100° F. (38° C.) to 300° F. (149° C.)). With the exception of the 1st sample at 100° F. (38° C.), all samples generated vapor space $H_2S$ concentrations greater than 500 ppm for over 42 days at 100° F. (38° C.), 212° F. (100° C.), and 300° F. (149° C.).

This data should indicate to one of skill in the art that elemental or weakly bound (and dissolved) sulfur is present in crude which contributes to the continuous emission of $H_2S$ at all temperatures for these samples. The emission is significant from a concentration standpoint and continuous, as the emission continued for a prolonged period of time. Upon mild heating, these samples showed very high levels of $H_2S$ evolution. The production of $H_2S$ from these materials treated in this way is not a transitory phenomenon, as continued $H_2S$ evolution occurs over a very long period of time. This indicates that shipments of sour crude E will begin to produce $H_2S$ in the vapor phase above the crude as soon as any heating begins and will continue to produce $H_2S$ throughout the period of heating.

Example 2

Heat Soaking Autoclave Runs

A limited number of autoclave runs were made to determine the impact of heat treatment on $H_2S$ formation/emission. The possible sources of $H_2S$ are dissolved $H_2S$ and/or $H_2S$ generated by reaction or decomposition of sulfur components within the crude oil. The purpose of the runs is to identify suitable thermal pretreatment conditions that would condition the crude so that subsequent $H_2S$ emission is minimized or eliminated during transportation and handling.

The heat treatment experiment generally involved types of runs that could be classified into two stages. In the first stage, several portions of the same crude oil sample were subjected to a wide range of heat treatment conditions, varying the temperature and time span of each run. In the second stage, the impact of the heat treatment during the first stage on subsequent $H_2S$ emission was monitored. A large number of these runs were conducted involving these two steps which are described in Tables 2 and 3. The purpose here is to give a typical example of and the results of this heat treatment experiment.

TABLE 2

VARIOUS TREATMENTS OF CRUDE TO REDUCE $H_2S$ FORMATION

| Sour 'E' Crude Sample 1 | Sample 2 | Sample 3 | |
|---|---|---|---|
| Initial $H_2S$ Reading | >4000 ppm | >4000 ppm | >4000 ppm |
| Step 1 | | | |
| Stirring | Max Rate | Max Rate | Max Rate |
| Temperature | 350° F. (177° C.)–400° F. (204° C.) | 400° F. (204° C.)–500° F. (260° F.) | 350° F. (260° C.)–380° F. (193° F.) |
| Time | 2 hrs. | 4 hrs. | 4 hrs. |
| N2 Purge | None | None | None |
| Step 2 | | | |
| Stirring | Max Rate | Max Rate | Max Rate |
| Temp | 150° F. (66° C.)–250° F. (121° C.) | 100° F. (38° C.) | 290° F. (143° C.) |
| Time | 80 min. | 90 min. | 90 min. |
| N2 Purge | Yes | Yes | Yes |
| $H_2S$ reading | 100 ppm | <25 ppm | 200 ppm |

TABLE 3

VARIOUS TREATMENTS OF CRUDE TO REDUCE $H_2S$ FORMATION

| 'Magnolia' Crude | Sample 1 | Sample 2 | Sample 3 | Sample 4 |
|---|---|---|---|---|
| Initial $H_2S$ Reading | <25 ppm | <25 ppm | <25 ppm | <25 ppm |
| Step 1 | | | | |
| Stirring | Max Rate | Max Rate | Max Rate | Max Rate |
| Temp | 300° F. (149° C.) | 400° F. (204° C.) | 500° F. (260° C.) | 600° F. (316° C.) |
| Time | 3 hrs. | 3 hrs. | 3 hrs. | 3 hrs. |
| N2 Purge | Yes | Yes | Yes | Yes |
| Step 2 | | | | |
| Stirring | Max Rate | Max Rate | Max Rate | Max Rate |
| Temp | 212° F. (100° C.) | 212° F. (100° C.) | 212° F. (100° C.) | 212° F. (100° C.) |
| 3 hrs. | <20 ppm | <20 ppm | <20 ppm | <20 ppm |
| 3 days | 269 ppm (1d) | <20 ppm | <20 ppm | <20 ppm |
| 14 days | >500 ppm (2d) | <20 ppm | <20 ppm | <20 ppm |

The results demonstrate that in these cases, involving both high and low sulfur content crude samples, heat treatment at 350° F. (177° C.) or below was not effective in reducing the $H_2S$ emission on subsequent heating. Only when heated to at least 400° F. (204° C.) or more for 3 hours with a N2 purge and a stirring means was a dramatic reduction in the $H_2S$ emissions noted.

To summarize the extensive amount of data gathered to optimize heat treatment conditions of the crude, it was found that relatively high temperatures, 300° F. (149° C.) to 600° F. (316° C.), and long residence times, 1 to 4 hours, were needed to effectively reduce the $H_2S$ producing capacity of the crude. This study also indicated that thermal soaking of the crude for $H_2S$ removal will require stirring and purging with inert gasses.

Example 3

Effect of Polyalkylamines on $H_2S$ Emissions

Different chemical agents that were theoretically potential $H_2S$ stabilizers or accelerators were reacted with a crude oil sample. Ten grams of the crude, measured to the nearest mg, was placed in a 125 ml glass bottle and was flushed with argon. Various amounts of the different chemical agents, generally 0.1 grams or 1%, plus an internal standard, 1 $\mu$L of D6-benzene, where then spiked into the bottle. The bottle was immediately sealed with a Teflon septum and was heated to 150° C. (302° F.). and held for 2 hours. The sample was allowed to cool to 40 degrees C. and reanalyzed by GC/MS. Then 0.1 ml of the vapor above the liquid crude was extracted with a gas syringe and directly injected and analyzed by a GC/MS. The evolved $H_2S$ was chromatographically separated from light naphthas and measured against both the internal standard D-6 benzene standard and a 40 ppm $H_2S$ external standard. In some cases, temperature and reaction times were varied. The results are shown in Table 4.

TABLE 4

THE EFFECT OF POLYALKYLAMINES ON $H_2S$ FORMATION

| 10 g of Sour Crude at 150° C. (302° F.) for 2 hours | Additive (g) | Relative Emissions |
|---|---|---|
| Control | None | 1.1 |
| TEPA (tetraethylene pentaamine) | .14 | 4.8 |
| TEPA (repeat) | .12 | 8.0 |
| TEPA, 1 hr, 200° C. (392° F.) | .10 | 4.3 |
| TEPA, 100° C. (212° F.), 2 hr | .1 | 0.0 |
| TEPA, 6 hr | .10 | 4.6 |
| DETA (diethylene triamine) | .10 | 3.2 |
| TEPA 250° C. (482° F.), 2 hr | .02 | 9.3 |
| PEHA (pentaethylene hexamine) | .10 | 14.0 |
| PEHA | .02 | 15.0 |
| PEHA | .02 | 11.5 |
| AEP (aminoethylpiperidine) | .1 | 11.9 |
| TACTD (1,4,8,11-tetra azocycloteteradecane) | .1 | 41.5 |
| TACTD & H2O | .1 | 4.8 |
| TACTD | .01 | 7.2 |
| (a) TACTD 1X | .1 | 21.0 |
| (b) TACTD 2X, 1 venting, 4 hours | .1 | 5.8 |
| (c) TACTD 3X, 2 ventings, 6 hours | .1 | 0.4 |

This study showed that among the various chemical agents used, polyalkylamines accelerate $H_2S$ formation approximately 5 to 15 times. Furthermore, the polyalkylamine reaction must be thermally initiated, as TEPA was not reactive at 100° C. (212° F.). All of the polyalkylamines significantly enhanced $H_2S$ emissions from the crude. However, the presence of water appears to have reduced the effectiveness of the TACTD. Water did not reduce $H_2S$ emissions for the other polyamines in previous experimental sets.

The last three reactions listed in Table 4 represent sequential experiments at two hour intervals. The initial reaction product, identified as (a), was performed in the normal manner. The second reaction, (b), represents 2 hours of heating, followed by flushing the reaction bottle completely of $H_2S$ with argon, resealing the bottle, and heating for an additional 2 hours (4 hours total). The third reaction, (c), represents 2 hours of heating, followed by an argon flushing, resealing and heating for an additional 2 hours, followed by another argon flushing, and an additional 2 hours of heating (6 hours total).

These experimental sets establish that polyalkylamine additives can effectively remove elemental sulfur (S8) from crudes by the rapid emission of $H_2S$. The $H_2S$ levels in the vapor space of the sample reach about 8000 ppm at two hours, 1000 ppm after three hours, and continues to drop to 500 ppm after 4 hours. In contrast, $H_2S$ levels in the crude samples with out the additive reached only 2000 ppm after two hours and dropped to 700 ppm after three hours, and remained fairly constant after four hours.

While the compositions and methods of this invention have been described in terms of preferred embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A process for removing sulfur from crude petroleum, comprising:

(a) heating the crude petroleum to a temperature of at least about 300° F. (149° C.);

(b) maintaining said temperature for a holding period;

(c) stirring the crude petroleum during the holding period; and (d) bubbling a substantially inert gas through the crude petroleum during the holding period, thereby generating an exhaust gas containing sulfur compounds.

2. The process of claim 1, wherein said holding period is between about 1 hour and about 4 hours.

3. The process of claim 1, wherein said temperature is between about 300° F. (149° C.) and about 600° F. (316° C.).

4. The process of claim 1, wherein said substantially inert gas comprises nitrogen.

5. The process of claim 1, wherein said substantially inert gas comprises a waste flue gas containing at least about 50% carbon dioxide.

6. The process of claim 1, wherein said stirring is applied at a rate between about 10 and about 5000 rpm.

7. The process of claim 1, further comprising cooling said exhaust gas to recover condensable hydrocarbons.

8. The process of claim 1, wherein said exhaust gas contains water vapor.

9. The process of claim 8, further comprising cooling said exhaust gas to condense the water vapor.

10. The process of claim 1, further comprising contacting said crude petroleum with a polyalkylamine during said holding period.

11. The process of claim 10, wherein said polyalkylamine is selected from the group consisting of diethylene triamine, tetraethylene pentaamine, and pentaethylene hexamine, aminoethylpiperidine and 1,4,8,11-tetra azocyclotetradecane.

12. The process of claim 11, wherein the concentration of said polyalkylamine in said crude petroleum is about 0.2% by weight.

13. The process of claim 10, wherein the concentration of said polyalkylamine is between about 100 and about 3000 ppm.

14. The process of claim 1, wherein the exhaust gas contains hydrogen sulfide.

* * * * *